US008671465B2

(12) United States Patent
Armstrong

(10) Patent No.: US 8,671,465 B2
(45) Date of Patent: Mar. 18, 2014

(54) NURSING CANOPY

(76) Inventor: Nancy Armstrong, Regina (CA)

( * ) Notice: Subject to any disclaimer, the term of this patent is extended or adjusted under 35 U.S.C. 154(b) by 224 days.

(21) Appl. No.: 13/202,515

(22) PCT Filed: Feb. 18, 2010

(86) PCT No.: PCT/CA2010/000225

§ 371 (c)(1),
(2), (4) Date: Aug. 19, 2011

(87) PCT Pub. No.: WO2010/094123

PCT Pub. Date: Aug. 26, 2010

(65) Prior Publication Data

US 2011/0296581 A1 Dec. 8, 2011

(30) Foreign Application Priority Data

Feb. 20, 2009 (CA) ..... 2654994

(51) Int. Cl.
*A41D 1/20* (2006.01)

(52) U.S. Cl.
USPC ..... 2/104; 2/48

(58) Field of Classification Search
USPC ..... 2/104, 88, 89, 92, 102, 69, 69.5, 48, 2/49.1, 49.3, 50, 51, 52, 114, 46, 49.2, 2/207
See application file for complete search history.

(56) References Cited

U.S. PATENT DOCUMENTS 788,489 A * 4/1905 Moore ..... 2/51
1,474,415 A * 11/1923 Glassbrenner ..... 2/48
2,421,195 A * 5/1947 Goldsmith ..... 2/48
4,987,612 A * 1/1991 Middleton ..... 2/104
4,995,116 A * 2/1991 Beauchamp et al. ..... 2/104
5,259,068 A * 11/1993 Carroll ..... 2/104
5,479,662 A * 1/1996 Runco ..... 2/104
5,544,364 A * 8/1996 Weber ..... 2/104
5,652,958 A 8/1997 Farrell-Mestas
5,893,171 A * 4/1999 Ries ..... 2/48
6,216,274 B1 * 4/2001 Harris ..... 2/104
7,207,070 B1 * 4/2007 Swarez-Ballesteros ..... 2/104
7,380,284 B1 * 6/2008 Dodani ..... 2/49.1
7,555,790 B2 7/2009 Ostrander
2008/0034462 A1 * 2/2008 Ekelund et al. ..... 2/104
2008/0201817 A1 * 8/2008 Ostrander ..... 2/52
2010/0281598 A1 * 11/2010 Densmore et al. ..... 2/104

FOREIGN PATENT DOCUMENTS

CA 2679007 8/2008
WO 2005074732 A1 8/2005

* cited by examiner

*Primary Examiner* — Amy Vanatta
(74) *Attorney, Agent, or Firm* — Dicke, Billig & Czaja, PLLP

(57) ABSTRACT

A nursing canopy for concealing a nursing mother's upper front torso and infant is disclosed. The canopy comprises a panel of opaque fabric having dimensions sufficient to cover at least a region from the mother's upper chest to below the mother's breasts. A fastening strap can be attached to the upper edge of the panel for securing the panel around the mother's neck. A self-supporting neckline stiffener is located along the top edge of the panel and defines a self-supporting neckline of the panel. The neckline cooperates with the fastening strap to hold the neckline a spaced-apart distance from the mother, defining an open viewing area between mother and infant. A secondary self-supporting stiffener is provided on the panel at a distance below the neckline, the ends of which rest against the mother's sides to hold the panel a spaced-apart distance from the feeding infant.

23 Claims, 8 Drawing Sheets

NURSING CANOPY

This invention is in the field of nursing canopies, and more specifically to such canopies that allow a nursing mother to discreetly breast-feed her infant, while providing convenient viewing and ventilation features for the comfort of the mother and infant.

BACKGROUND

It has long been shown that a mother's breast milk is a unique source of nutrition for infants that cannot adequately be replaced by any other source, including infant formula. While infant formula is able to mimic some of the nutritional components of a mother's breast milk, it cannot adequately duplicate the ever-changing range and balance of nutrients important to a child's health that is present in breast milk. Numerous studies show that breast milk provides superior benefits in terms of infant health, immunity, growth, and development. Breastfeeding also provides health benefits to a mother, including a reduction in the likelihood of developing osteoporosis, help with losing the weight that accompanies pregnancy, and a lower risk of breast, uterine, and ovarian cancer. Breastfeeding also has economic advantages because it is cheaper than buying formula. Perhaps most importantly, breastfeeding provides a unique opportunity for a mother to grow both emotionally and physically from the relationship formed with her baby. The act of breastfeeding is an intimate and personal experience for mother and child, which helps to promote a natural bond, resulting in a stronger sense of connection between mother and child. It is thus apparent why many people desire to breastfeed their children.

However, while breastfeeding can be very advantageous to both child and mother as compared to bottle-feeding, many mothers choose not to breastfeed their children. One reason for this may be the inconvenience of frequently breastfeeding an infant in public where access to privacy is unavailable. Frequently, a mother must nurse at times and in places where she cannot easily, or does not wish to, locate a secluded area to nurse. This can lead to uncomfortableness for the mother, since it is difficult for a mother to conceal or cover the exposed breast while nursing an infant. There have been items and garments proposed to allow an infant to nurse while concealing the mother's upper body; however, there are several limitations associated with these items, including that they are often inadequate, bulky, uncomfortable, awkward to use, unsafe, or difficult to handle.

To address the issue of having to expose all or part of her breast and upper portions of her torso in public or in high-traffic areas, some mothers use conventional solutions such as covering the exposed areas with towels, sheets, blankets, or the like. However, there are many drawbacks associated with draping such a covering over oneself when nursing. When draping a covering a material over oneself to protect the exposed breast, the covering also inevitably drapes over the nursing infant. This covering may not provide adequate ventilation of the air around the child, posing a risk of asphyxiation or overheating. Furthermore, the covering is not secured in place and could slip, revealing the mother's breast and disturbing the mother and child's privacy. For this reason, a mother is often preoccupied with holding the covering in place, which could prove difficult if the child is moving. Yet another concern is that covering the child's face with a cover in this way obstructs the view of the child to the mother and the mother to the child. A proper view is necessary in order to help the infant properly latch on to the breast, and also to encourage the bonding experience between mother and child.

Other proposed solutions are the use of nursing garments that are primarily articles of clothing that allow a mother to nurse while keeping her breasts substantially covered. However, such articles of clothing do not allow the mother the choice and flexibility of wearing a conventional selection of clothing. Some garments of this sort furthermore do not conceal the breast and nursing child sufficiently during nursing. They have the further disadvantage of requiring mothers to purchase more than one nursing garment.

There are also conventional nursing canopies available. These canopies are worn over a mother's clothing and cover the mother's upper torso in the front and over the arms. Such canopies allow the mother to handle the infant with both hands while concealing the mother's breasts and the nursing infant from public view. However, conventional canopies typically have necklines which sag downward against the upper chest or neck of the user. This sagging neckline obstructs the intimate view of the infant and the mother, thus preventing the mother from readily viewing and monitoring the nursing infant. In order to allow the infant to latch on to the mother's breast and to properly position the infant during nursing, the mother would have to use one or both hands to lift the neckline of the canopy outward and away from her body, while also holding the infant and monitoring the infant. A further problem with conventional nursing canopies is that the material of the nursing canopy drapes over the head and face of the infant trying to nurse, which can be distracting for the child, causing them to refuse to nurse. Additionally, the material of the canopy resting so close to the child and the mother prevents proper flow of air and circulation beneath the canopy, which increases the body temperature of the mother and child, resulting in very difficult and uncomfortable breastfeeding.

SUMMARY OF THE INVENTION

It is an object of the present invention to provide a nursing canopy that overcomes problems in the prior art.

In a first embodiment the present invention, a nursing canopy for shielding the upper front torso of a mother and her nursing infant is provided. The canopy comprises an opaque panel of fabric having a top edge, a bottom edge, a first side edge, and a second side edge, and having a height and width sufficient to substantially cover at least from the mother's upper chest to below the mother's breasts. A neck strap is connected to the top edge of the panel for extending around the neck of the mother and is configured to suspend the panel of fabric from the mother's neck. A first strip of resiliently flexible material has a stiffness greater than the panel of fabric and is configured to prevent the upper edge of the panel from resting against a front neck portion of the mother by bowing outward and whereby a viewing area is left between the mother and the upper edge of the panel that allows at least a portion of the infant to be viewed by the mother. A second strip of resiliently flexible material has a stiffness greater than the panel of fabric and is configured to prevent a midsection of the panel from resting against the infant's head and face. In this way, the fabric panel is held outward and away from the feeding infant by the second strip of resiliently flexible material, and such that the fabric panel below the second strip of resiliently flexible material drapes downward.

In a second embodiment, the present invention provides a method of discreetly nursing an infant. The method comprises providing a nursing canopy comprising a panel of fabric having a height and width sufficient to substantially cover at least from a mother's upper chest to below a mother's breasts; a first strip of resiliently flexible material having a stiffness greater than the panel of fabric and configured to prevent an upper edge of the panel from resting against a front neck portion of the mother by bowing outward and whereby a viewing area is left between the mother and the upper edge of the panel that allows at least a portion of the infant to be viewed by the mother; and a second strip of resiliently flexible material having a stiffness greater than the panel of fabric and configured to prevent a midsection of the panel from resting against the infant's head and face; and suspending the nursing canopy around the mother's neck. This method protects the modesty of a mother while nursing a baby and allows the necessary ventilation, allows an uninhibited view of mother to child, and does not distract the feeding infant. The nursing canopy is oriented such that first strip of resiliently flexible material extends outwardly from a neck area of a mother to define an open viewing area, and such that a feeding infant and the mother have uninhibited views of one another when breastfeeding. The canopy is further oriented such that second strip of resiliently flexible material extends outwardly from the torso area of the mother and the feeding infant. The nursing canopy used in this method conceals the mother's upper chest and arms and infant when breastfeeding, while at the same time being held outward from the mother's torso and from the nursing baby so as not to inhibit flow of air or distract the feeding of the baby.

The present invention effectively allows a mother and infant privacy while nursing. When worn, the nursing canopy covers the breastfeeding baby and a mother's upper torso, allowing a mother to adjust her clothing beneath the canopy so she can expose her breast and feed her infant discreetly and inconspicuously. The canopy also allows a mother and infant to have an unobstructed, continuous view of one another by providing a viewing area for the mother to observe and monitor the baby. Furthermore, the canopy provides improved air circulation for the infant when covered without smothering or distracting the baby by preventing the fabric panel from resting against the baby's head and face.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
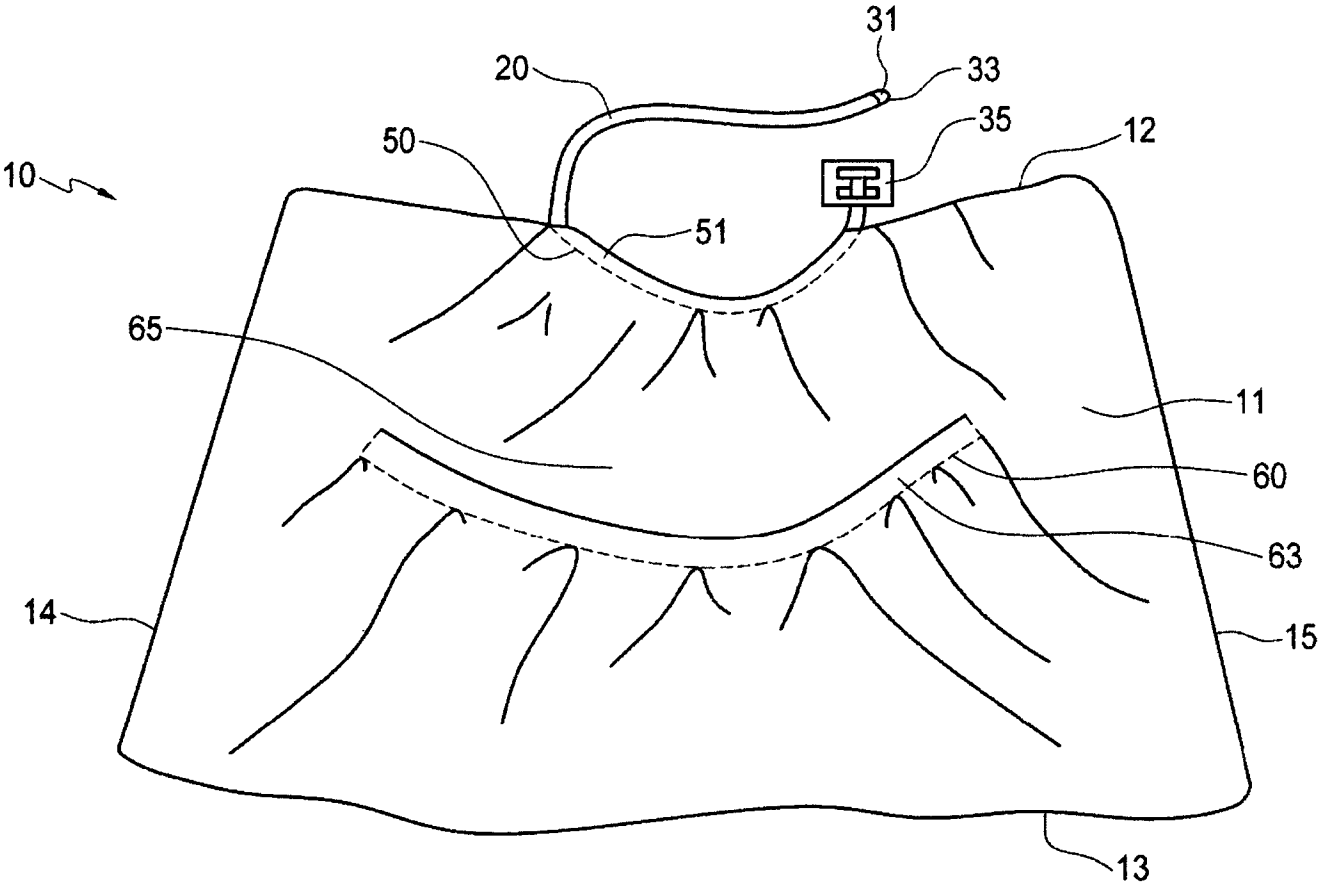
FIG. 1 is a front perspective view of a nursing canopy as resting against a flat surface.
Figure 2:
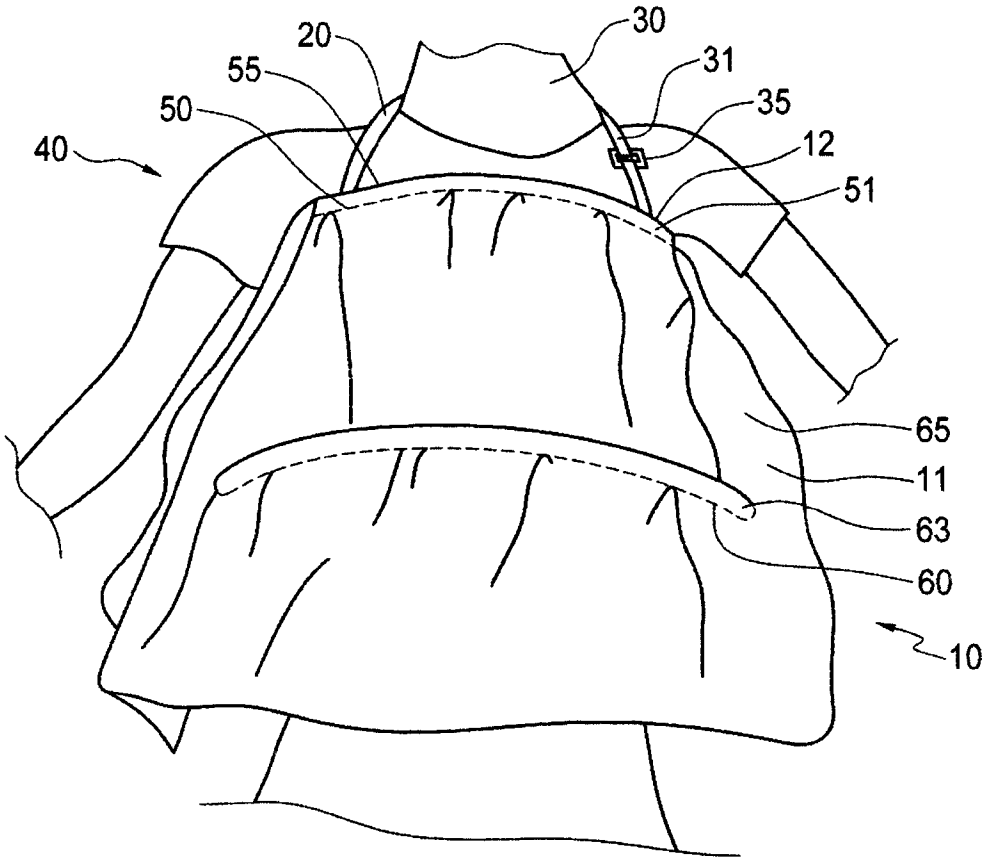
FIG. 2 is a front view of the nursing canopy shown in FIG. 1 as worn by a mother.
Figure 3:
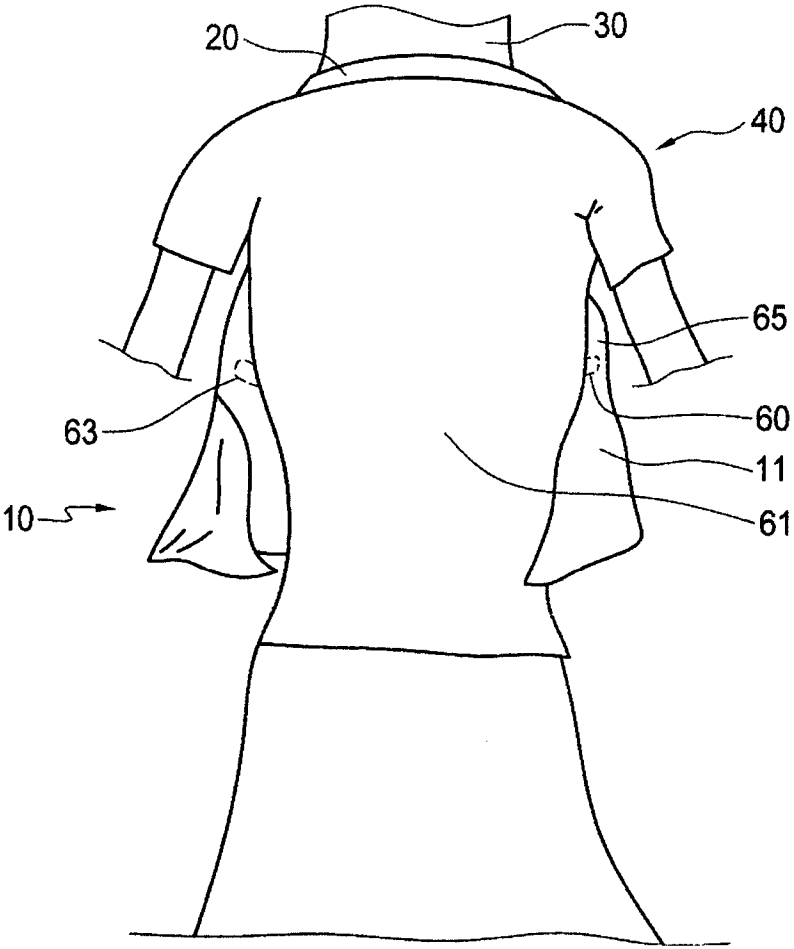
FIG. 3 is rear view of the nursing canopy shown in FIG. 1 as worn by a mother.
Figure 4:
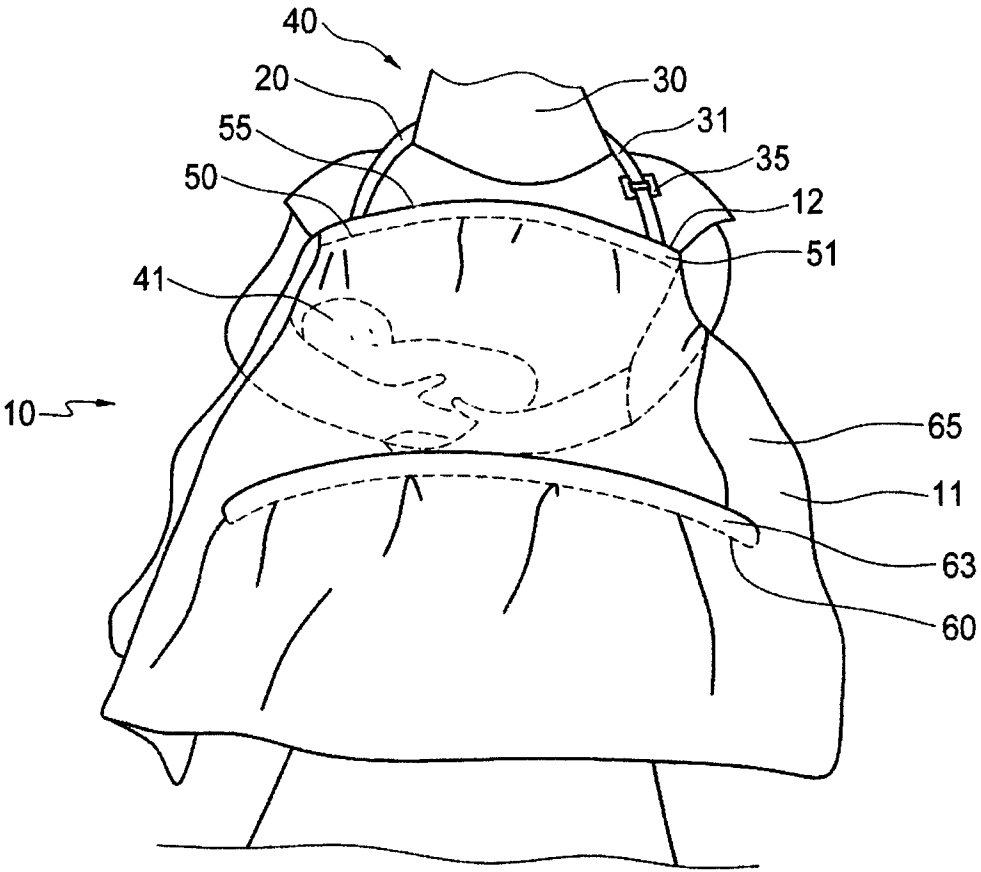
FIG. 4 is a front perspective view of the nursing canopy shown in FIG. 1 as worn by a mother and her feeding infant.
Figure 5:
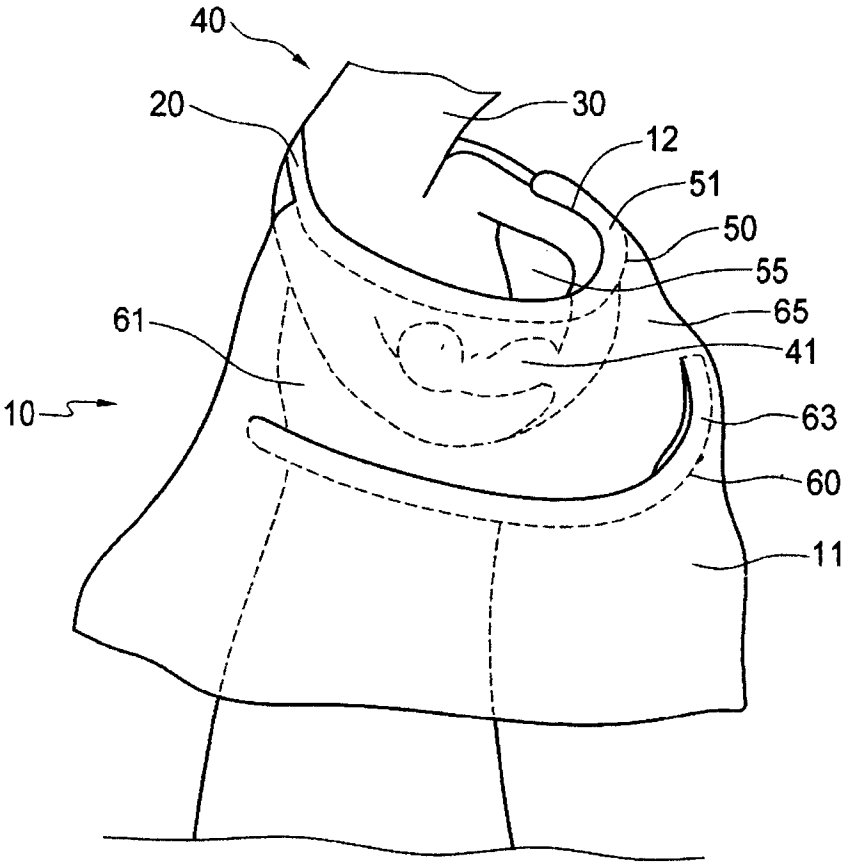
FIG. 5 is a side perspective view of the nursing canopy shown in FIG. 1 as worn by a mother and her feeding infant.

As outlined above, the invention is a nursing canopy having a double-boning system that allows a mother and infant to have an unobstructed, continuous view of one another by providing a viewing area between the mother and the baby and which provides improved air circulation for the infant and mother without smothering or distracting the baby.

FIGS. 1-5 show a nursing canopy 10 in an embodiment of the present invention. The nursing canopy 10 has an opaque fabric panel 11 having an upper edge 12, lower edge 13, a first side edge 14, and a second side edge 15 and which is of sufficient dimension to cover a nursing baby and its mother's upper front torso, from the neck to at least below her breasts and from approximately one armpit to the other. The fabric of the panel 11 is generally a lightweight, breathable fabric to allow for adequate airflow, such as cotton, wool, or a woven fabric blend. It will be appreciated that the fabric panel 11 could optionally be made out of an opaque eyelet material for increased ventilation. Such eyelet material would have small embroidered holes approximately 0.2 cm. in diameter spaced sparsely through the fabric panel 11. However, it is contemplated within the scope of this invention that any opaque, flexible fabric of generous size to ensure the modesty of the nursing mother could be selected and used, including synthetic fabrics, plastic, and robust paper. The panel 11 shown in FIG. 1 has a generally rectangular shaped periphery, although it is anticipated that the panel 11 could be given any geometrical configuration, such as a semi-circle, an isosceles trapezoid, an ellipse, or a rectangle with rounded corners, so long as the dimensions of the panel 11 are sufficient to cover a mother's upper front torso and infant.

Referring again to FIGS. 1-5, a neck strap 20 is attached to the upper edge 12 of the panel 11, which extends around the back of the user's neck 30 to suspend the panel 11 from the neck 30. The neck strap 20 can be made of any material that can be configured to hold the panel 11 in place and can be the same or different fabric than the panel 11. The neck strap 20 is provided with cooperating attachment means located at opposite ends for closure purposes in order to secure the canopy 10 around the mother's neck 30 and for varying the size of the neck strap 20. The neck strap 20 could include a first fastener member 31 at a free end of the strap 33 for attaching the free end 33 to the panel 11 and a second, complementary fastener member 35 located at the opposite side of the panel 11 for mating with the first fastener member 31 of the neck strap 20. The first and second fastener members 31 and 35 could be hook and loop fasteners or any other sort of releasable attachment means such as buckles, snap buttons, magnets, hooks, clamps, or D-rings or O-rings. The embodiment shown in FIGS. 1-5 shows a neck strap 20 comprising two adjustable straps including a slide buckle 35 and neck fastening strap 31, each attached to the upper edge 12 of the panel 11 and spaced a distance apart. The neck fastening strap 31 can be configured to extend around the mother's neck 30 and snuggly and adjustably fit the slide buckle 35, with a fit that is sufficient to prevent unintentional slippage. Alternatively, the neck strap 20 could comprise two free ends of fabric at opposite sides of the panel 11 which are optionally adjustable through slide buckle means or the like, and which could be tied in a knot around the back of the user's neck 30 to securely suspend the panel 11 for use. In the further alternative, the neck strap 20 comprises a single elastic band fastened at each end to the panel 11 such that a user 40 need only stretch the band over their neck 30 with the elastic band withstanding the stress of the weight of the panel 11 to suspend the panel 11 in front of the user 40. In yet a further alternative, the neck strap 20 could comprise a continuous loop of material attached to the upper edge 12 of the panel 11 whereby a mother 40 can slip her head through the loop to hold the canopy 10 in place. It will be understood within the scope of the invention that any adjustable and releasable fastening methods and devices could be employed in suspending the panel 11 from the user's neck 30.

A self-supporting neckline stiffener 50 is secured horizontally across the upper edge 12 of the panel 11 to define a self-supporting neckline 51. The neckline stiffener 50 comprises an elongate strip made out of a semi-stiff resiliently flexible material with a stiffness greater than the fabric panel 11 and configured to prevent the upper edge 12 of the panel 11 from resting against the mother 40 and baby 41 by bowing outward. Such materials would include flexible plastics, metal, boning, synthetic woven fabrics, wood, or polymeric sheets or strips. The neckline stiffener 50 is fastened horizontally across the upper edge 12 of the panel 11 through the use of any method or device that can securely fasten the neckline stiffener 50 to the panel 11, including the use of glue or the like. The neckline stiffener 50 could also be sewn or stitched into the upper edge 12 of the panel 11 to define the neckline 51, though again, any form of securely fastening the neckline stiffener 50 is anticipated and falls within the scope of the present invention. The neckline stiffener 50 fastened in this way cooperates with the neck strap 20 to hold the neckline stiffener 50 a spaced-apart distance from the front neck area of the mother 40, thus defining an open viewing area 55 such that the mother 40 is capable of readily viewing her feeding infant 41.

In addition to the self-supporting neckline stiffener 50, a secondary stiffener 60 that naturally extends outwardly from the baby 41 and body 61 of the mother 40 during wear is secured horizontally across the panel 11 at a distance below the neckline 51, to define a self-supporting rib 63. Typically the secondary stiffener 60 is greater in length than the neckline stiffener 50. The secondary stiffener 60 comprises an elongate strip made out of a semi-stiff resiliently flexible material with a stiffness greater than the fabric panel 11 and configured to hold a midsection 65 of the panel 11 outward and away from the baby 41 and the torso 61 of the mother 40, and particularly to prevent the fabric panel 11 from resting against the baby's head and face, by bowing outward. Such materials would include flexible plastics, similar to the material of the neckline stiffener 50 and is selected so as to have sufficient stiffness when the canopy 10 is used to permit the rib 63 to be essentially self-supporting when its ends are leaning against the mother 40. The secondary stiffener 60 is also fastened horizontally across the panel 11 below the neckline 51 through the use of any method or device that can securely fasten the secondary stiffener 60 to the panel 11, similar to the neckline stiffener 50, and would include sewing or stitching the secondary stiffener 60 into the midsection 65 of the panel, or through the use of glue or laminate, though again, any form of securely fastening the secondary stiffener 60 is anticipated and falls within the scope of the present invention. The secondary stiffener 60 fastened in this way cooperates with the sides of the mother's torso 61, resting somewhat against the mother's sides to hold the secondary self-supporting stiffener 60 a spaced-apart distance from the front torso area of the mother 40 and the feeding infant 41. In this way, the fabric panel 11 is held outward and away from the feeding infant 41 by the self-supporting rib 63, and such that the fabric panel 11 below the rib 63 drapes downward.

To use the nursing canopy 10, a user 40 orients the canopy 10 such that the self-supporting neckline 51 extends outwardly from a neck area of the user 40 to define an open viewing area 55, and such that the feeding infant 41 and the mother 40 have uninhibited views of one another. The canopy 10 is further oriented such that the secondary self-supporting rib 63 below the neckline 51 extends outwardly from the torso area 61 of the mother 40 and the feeding infant 41. The canopy 10 is then suspended from the neck 30 of the user 40 by wrapping the neck strap 20 attached to the upper edge 12 of the canopy 10 around the back of the neck 30 of the user 40 and releasably fastening the neck strap 20 to the opposite side of the panel 11. The neck strap 20 can then be adjusted using a slide buckle 35 on the neck strap 20 or other adjustment means, if applicable, to fit the mother 40 comfortably such that the panel 11 hangs at an appropriate length and position on the mother 40. The nursing canopy 10 suspended in this way conceals the user's upper chest and infant 40 when breastfeeding, while at the same time being held outward from the user's torso 61 and from the nursing baby 40 so as not to inhibit flow of air or distract the feeding of the baby 40.

Figure 6:
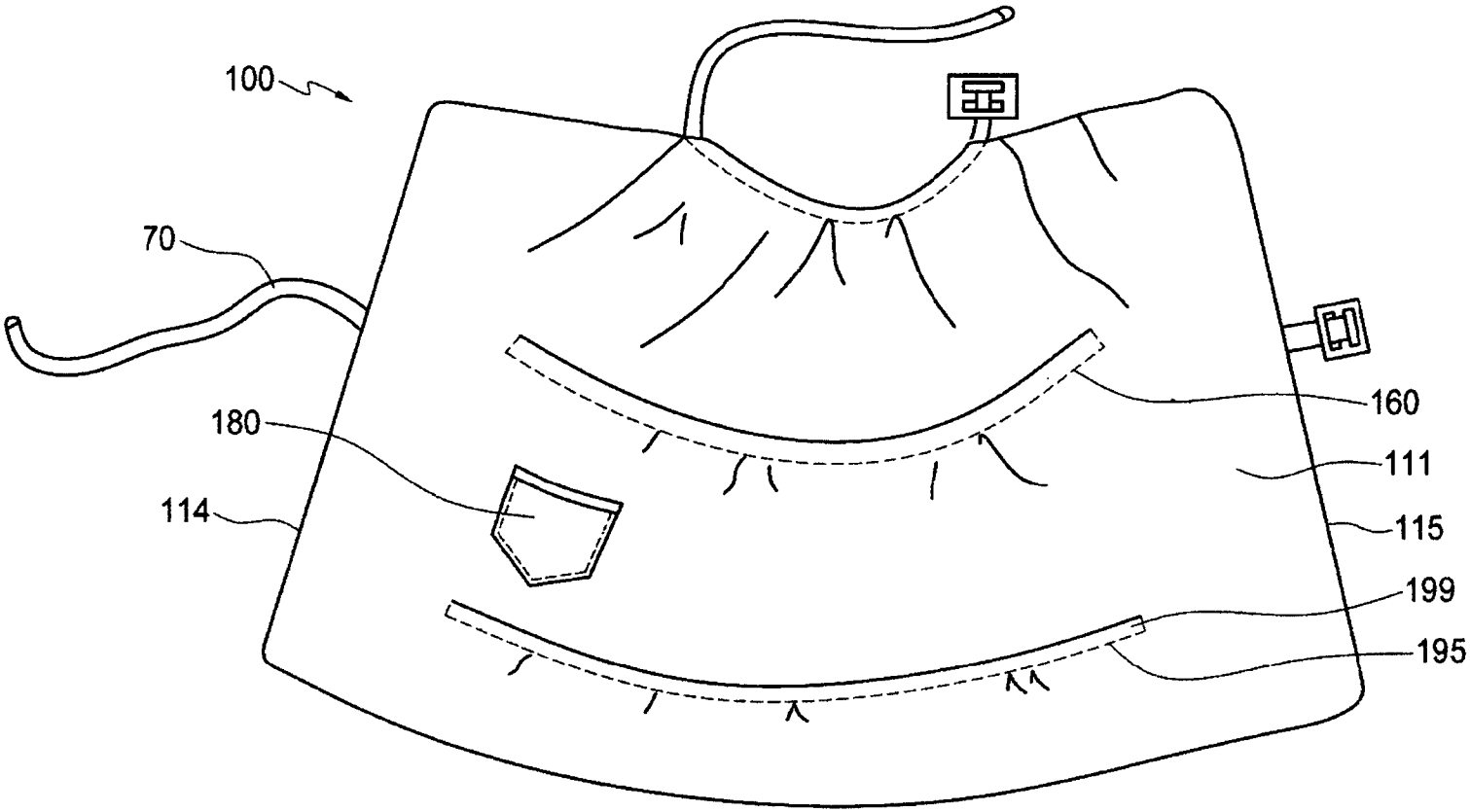
FIG. 6 is a front perspective view of a nursing canopy having a back strap.
Figure 7:
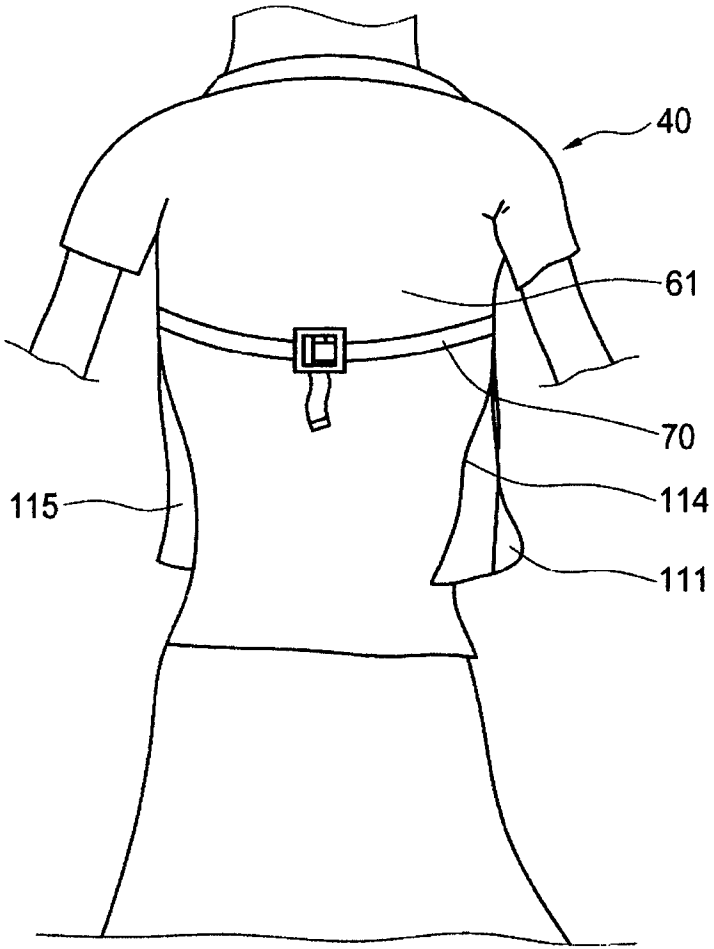
FIG. 7 is a rear view of the nursing canopy shown in FIG. 6 as worn by a mother.

Further additions or modifications of the nursing canopy, as described above, are contemplated within the scope of the present invention. For example, in reference to FIGS. 6 and 7, it is contemplated that one or more back straps 70 could be provided that can optionally be attached to a side edge 114 of the panel of fabric 111 and which extend from one side of the user 40 to the opposite side of the wearer 40 for extending around the back of the torso 61. The one or more back straps 70 are configured to releasably attach to the opposite side edge 115 or to each other through detachable engagement, such as through the use of buttons, hook and loop fasteners, clasps, buckles, or the like. In one aspect, the one or more back straps 70 can be continuously adjustable. The panel 111 may also optionally include one or more pockets 180 to hold various baby accessories or otherwise on the inside or outside of the canopy 100. It is also anticipated that any number of additional ribs could be added to the canopy panel 111 without deviating from the scope of the invention. For example, a tertiary self-supporting stiffener 195, typically of greater length than the secondary stiffener 160, but not necessarily, could be secured to the panel 111 at a distance below the secondary stiffener 160 to define another rib 199. Further stiffeners could be added in this manner to give the panel 111 a more rigid structure, depending on the particular needs of the mother 40 and infant.

Figure 8:
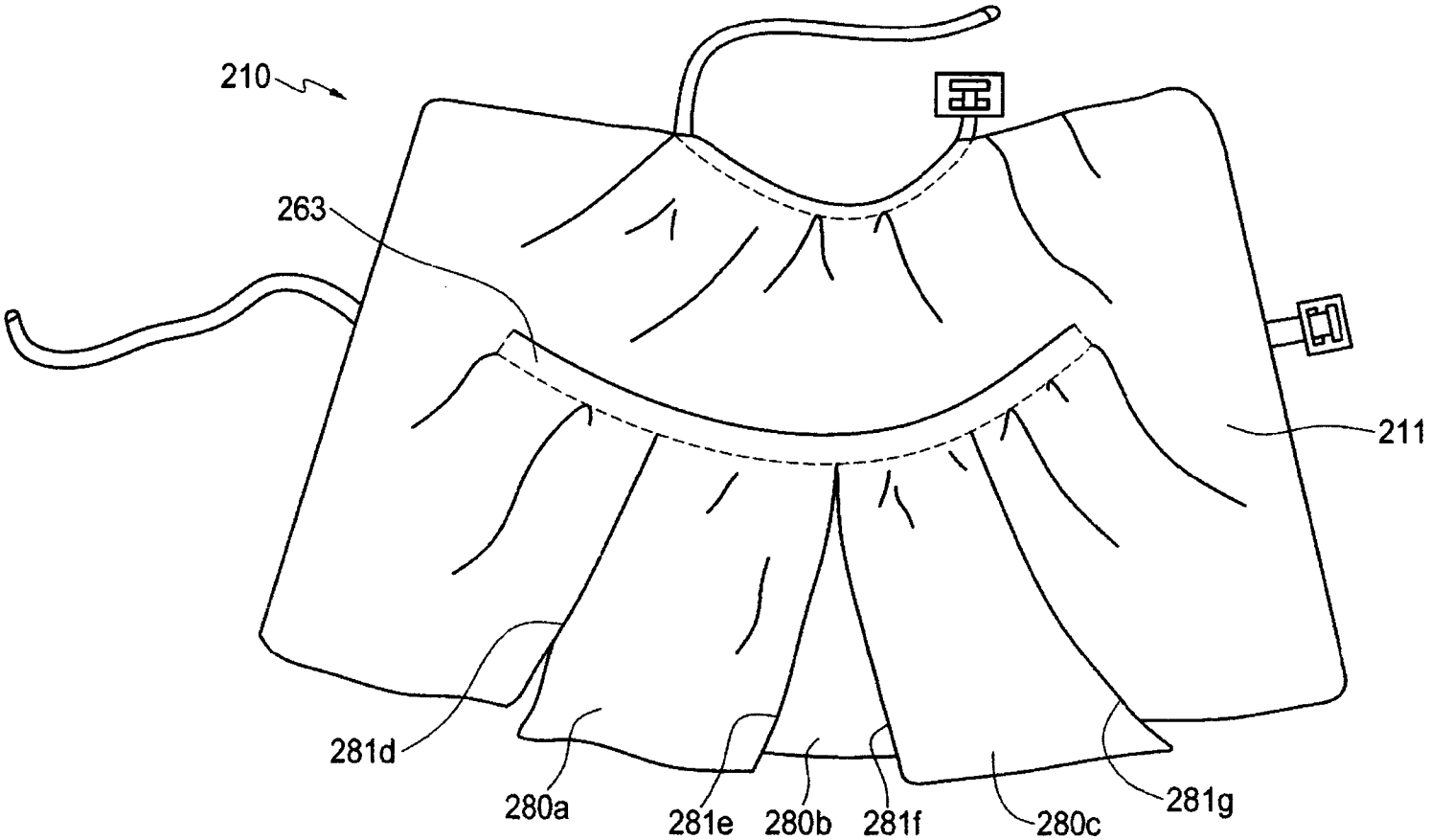
FIG. 8 is a front perspective view of a nursing canopy having a back strap and overlapping panel members.

Referring to FIG. 8, it is contemplated that the panel 211 extending below the self-supporting rib 263 could optionally comprise a plurality of overlapping panel members 280*a*, 280*b*, and 280*c* and having a plurality of vertically disposed openings 281*d*, 281*e*, 281*f*, and 281*g*, whereby the overlapping panel members 280*a*, 280*b*, and 280*c* and vertically disposed openings 281*d*, 281*e*, 281*f*, and 281*g* allow the mother 40 a greater range of movement below the canopy 210 and greater access to her infant 41 beneath the nursing canopy 210. FIG. 8 shows three overlapping panel members 280*a*, 280*b*, and 280*c*, which create fullness in the canopy 210 for unconfined movement beneath the self-supporting rib 263.

The embodiments described herein have described a nursing canopy and method of using such canopy to protect the modesty of a mother while nursing an infant. The nursing canopy allows the necessary ventilation, allows an uninhibited view of mother to child, and does not distract the feeding infant.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A nursing canopy for shielding an upper front torso of a mother and a nursing infant comprising:

an opaque panel of fabric having a top edge, a bottom edge, a first side edge, and a second side edge, and having a height and width sufficient to substantially cover at least from an upper chest of the mother to below breasts of the mother;

a neck strap connected to the top edge of the panel for extending around a neck of the mother and configured to suspend the panel of fabric from the neck of the mother;

a first strip of resiliently flexible material having a stiffness greater than the panel of fabric and configured to prevent the upper edge of the panel from resting against a front neck portion of the mother by bowing outward and wherein a viewing area is left between the mother and the upper edge of the panel that allows at least a portion of the infant to be viewed by the mother; and a second strip of resiliently flexible material having a stiffness greater than the panel of fabric extending across a midpoint between the first side edge and the second side edge and configured to prevent a midsection of the panel from resting against a head and face of the infant.

2. The nursing canopy of claim 1, wherein at least one additional strip of resiliently flexible material having a stiffness greater than the panel of fabric is configured to provide reinforcement in preventing the midsection of the panel from resting against the head and face of the infant.

3. The nursing canopy of claim 1, wherein the first strip of resiliently flexible material is sewn into at least part of a seam of the upper edge of the panel.

4. The nursing canopy of claim 1, wherein the second strip of resiliently flexible material is sewn or stitched into the midsection of the panel at a distance below and substantially parallel to the first strip of resiliently flexible material.

5. The nursing canopy of claim 1, wherein the neck strap includes a continuously adjustable portion to vary the size of the neck strap.

6. The nursing canopy of claim 1, wherein the neck strap is provided with cooperating attachment means located at opposite ends for closure purposes and for varying the size of the neck strap.

7. The nursing canopy of claim 6, wherein the neck strap includes a buckle of the slide buckle type.

8. The nursing canopy of claim 1, wherein a pocket is provided on the panel.

9. The nursing canopy of claim 1, wherein a portion of the panel extending below the second strip of resiliently flexible material comprises a plurality of overlapping panel members and at least one vertically disposed opening.

10. The nursing canopy of claim 1, comprising a back strap configured to extend from the first side of the panel around a back of a wearer to releasably connect the first side of the panel to the second side of the panel.

11. The nursing canopy of claim 1, wherein the panel of fabric is continuous along its length from the first strip of resiliently flexible material to the second strip of resiliently flexible material.

12. A method of discreetly nursing an infant, the method comprising:

providing a nursing canopy comprising:

a panel of fabric having a height and width sufficient to substantially cover at least from an upper chest of a mother to below breasts of the mother;

a first strip of resiliently flexible material having a stiffness greater than the panel of fabric and configured to prevent an upper edge of the panel from resting against a front neck portion of the mother by bowing outward and wherein a viewing area is left between the mother and the upper edge of the panel that allows at least a portion of the infant to be viewed by the mother; and a second strip of resiliently flexible material having a stiffness greater than the panel of fabric extending across a midpoint between a first side edge and a second side edge of the panel of fabric and configured to prevent a midsection of the panel from resting against a head and face of the infant; and suspending the nursing canopy around a neck of the mother.

13. The method of claim 12, wherein at least one additional strip of resiliently flexible material having a stiffness greater than the panel of fabric is configured to provide reinforcement in preventing the midsection of the panel from resting against the head and face of the infant.

14. The method of claim 12, wherein the first strip of resiliently flexible material is sewn into at least part of a seam of the upper edge of the panel.

15. The method of claim 12, wherein the second strip of resiliently flexible material is sewn into the midsection of the panel at a distance below and substantially parallel to the first strip of resiliently flexible material.

16. The method of claim 12, wherein the nursing canopy is suspended around the neck of the mother by a neck strap.

17. The method of claim 16 wherein the neck strap comprises a continuously adjustable portion to vary the size of the neck strap.

18. The method of claim 16, wherein the neck strap is provided with cooperating attachment means located at opposite ends for closure purposes and for varying the size of the neck strap.

19. The method of claim 18, wherein the neck strap includes a buckle of the slide buckle type.

20. The method of claim 12, wherein a pocket is provided on the panel.

21. The method of claim 12, wherein a portion of the panel extending below the second strip of resiliently flexible material comprises a plurality of overlapping panel members and vertically disposed openings.

22. The method of claim 12, further comprising providing a back strap configured to extend from the first side of the panel around a back of a wearer to releasably connect the first side of the panel to the second side of the panel.

23. The method of claim 12, wherein the panel of fabric is continuous along its length from the first strip of resiliently flexible material to the second strip of resiliently flexible material.

* * * * *